US005642671A

United States Patent [19]

Winheim

[11] Patent Number: 5,642,671

[45] Date of Patent: Jul. 1, 1997

[54] METHOD AND APPARATUS FOR PRINTING A MATERIAL WEB

[75] Inventor: Stefan Winheim, Frankfurt, Germany

[73] Assignee: V.I.B. Apparatebau GmbH, Maintal, Germany

[21] Appl. No.: 640,283

[22] Filed: Apr. 24, 1996

Related U.S. Application Data

[62] Division of Ser. No. 521,306, Aug. 30, 1995.

[30] Foreign Application Priority Data

Sep. 2, 1994 [DE] Germany ..... 44 31 252.0

[51] Int. Cl.[6] ..... B41F 35/00

[52] U.S. Cl. ..... 101/424.1; 34/391; 34/392; 34/411; 34/414; 34/415; 34/427; 34/431; 34/434; 34/65; 34/66; 34/540; 34/451

[58] Field of Search ..... 101/487, 488, 101/424.1, 227; 34/343, 381, 389, 391, 392, 411, 414, 415, 459, 463, 451, 454, 444, 445, 446, 447, 449, 419, 421, 422, 427, 431, 434, 461, 465, 468, 469, 471, 474–476, 611, 589–590, 509, 540

[56] References Cited

U.S. PATENT DOCUMENTS

| | | | |
|---|---|---|---|
| 2,157,388 | 5/1939 | MacArthur | 34/419 |
| 2,441,357 | 5/1948 | Hibbert | 34/540 |
| 2,464,119 | 3/1949 | Dawson | 61/424.1 |
| 2,884,706 | 5/1959 | Svavar et al. | 34/346 |
| 3,318,018 | 5/1967 | Steele et al. | 34/62 |
| 3,411,217 | 11/1968 | Daley | 34/391 |
| 4,506,457 | 3/1985 | Lehtinen | 34/454 |
| 4,567,673 | 2/1986 | Böhnensieker | 34/454 |

FOREIGN PATENT DOCUMENTS

| | | | |
|---|---|---|---|
| 591616 | 8/1947 | United Kingdom | 101/424.1 |

*Primary Examiner*—Eugene H. Eickholt
*Attorney, Agent, or Firm*—Friedrich Kueffner

[57] ABSTRACT

A method of printing a material web includes the steps of applying ink to the material web, subsequently drying the material web with the use of heat and subsequently drying the material web, and, after cooling and prior to further processing, moistening the material web while simultaneously applying heat to the material web, and subsequently once again cooling the material web. An apparatus for carrying out the method includes, in a travel direction, a printing unit, a drying section following the printing unit, a cooling section following the drying section, a moistening section following the cooling section, and an after-cooling section following the moistening section.

10 Claims, 2 Drawing Sheets

METHOD AND APPARATUS FOR PRINTING A MATERIAL WEB

This is a division of patent application Ser. No. 08/521,306 filed Aug. 30, 1995.

BACKGROUND OF THE INVENTION

1. Field of the Invention

The present invention relates to a method of printing a material web, particularly a paper web. The method includes applying a printing ink on the material web, drying the material web with the use of heat and subsequently cooling the material web.

The present invention also relates to an apparatus for printing a material web including a printing unit, a drying section and a cooling section.

2. Description of the Related Art

When printing a material web, the printing ink is in most cases applied in liquid form. Because of the high travel speeds of paper webs used today, the ink is usually not yet sufficiently dried when the paper web leaves the printing unit. In order to nevertheless be able to carry out further processing steps immediately after printing, for example, cutting, folding, stacking and stitching or stapling of the printed web, the web is guided through a dryer section in which the printing inks are dried with the use of heat. However, in the warm state the printing inks have a certain stickiness which is a disadvantage when printed sheets are stacked because the sheets then adhere to each other. For this reason, the material web is cooled after drying.

It has now been found that, while the cooled material web is no longer sticky, the material web has a number of other properties which make further processing of the material web more difficult or which lead later during use to unpleasant concomitant phenomena. For example, rattling or creasing of the paper reduces the comfort of the person looking at the paper. Accordingly, an elimination of these phenomena would be desirable. However, more critical are changes in the paper web which make the further processing of the paper web more difficult. For example, after such a treatment of the paper web, it can frequently be observed that the web becomes brittle which, when the web is folded, sometimes leads to breaks at the fold. Stapling also becomes more difficult because the staple penetrates unimpededly through one or more paper layers.

SUMMARY OF THE INVENTION

Therefore, it is the primary object of the present invention to improve the manipulation properties of the material web after printing, In a method of the above-described type, after cooling and prior to further processing, the material web is moistened with the simultaneous application of heat and is subsequently cooled once again.

Moistening of the paper web provides the result that the dampness of the paper is increased and, thus, the manipulation properties are improved. The fragility and brittleness decrease. Although this has not yet been fully determined, it is assumed that the simultaneous application of heat and moisture has a positive effect with respect to the absorption capacity of the paper for moisture, on the one hand, and that the material web itself is somewhat changed at least on its surface, on the other hand. It is likely that both factors work together. The subsequent cooling of the paper web further increases the relative moisture content of the paper web which, in turn, leads to a further improvement of the manipulation properties. Moreover, the printing inks which may have once again become sticky as a result of heating, are prevented by the additional cooling step from causing layers of paper webs to stick together when the paper web is stacked.

In accordance with a preferred further development of the present invention, the material web is moistened by the application of steam or vapor which condenses on the material web. Contrary to spraying with water or another liquid, the application of steam has the advantage that no droplets are formed which would lead to markings, i.e., to irregularities or waviness of the surface. However, the formation of a condensate layer on the paper web produces a uniform film which moistens the web uniformly without the formation of markings.

In accordance with a preferred feature, the quantity of the supplied steam is limited in such a way that the steam condenses on the material web without the formation of droplets. Even though, when such a limitation is lacking, these droplets do not have a negative effect on the material web, it is prevented nevertheless that the droplets separate from the material web and drop down. Such a separation of droplets interferes with the liquid layer on the surface of the material web, which is to be prevented in principle.

In accordance with an advantageous feature, the steam is conducted against the material web from below. This increases the efficiency. In contrast to the colder air, the hot steam always has the tendency to rise towards the top. By supplying the steam from below, this effect is utilized in an advantageous manner.

In accordance with a preferred feature, cooling takes place immediately after the application of steam. This provides the result that the increased temperature, i.e., a temperature of approximately 100° C., is applied only to the surface of the web. The penetration of the heat into the interior of the paper web is generally prevented by the printing inks or a previously applied layer. Of course, the penetration of heat is not completely prevented. The penetration of heat merely requires a certain time. If cooling now is carried out immediately after the application of steam, the heat is removed from the surface before it can penetrate into the interior of the material web and lead to changes in the structure of the material web.

In accordance with an advantageous feature, the moisture is applied to the material web in front of a roll which is at least partially surrounded by the moistened side of the material web. In this manner, a wedge of moisture is formed between the material web and the roll where the moisture of the film formed on the surface of the material web is pressed into the material web. The angle of contact between the roll and the material web may be relatively small. It is only necessary to ensure that a certain contact pressure of the material web against the roll is present. The contact pressure may also be effected by a pressure roll when the angle of contact approaches zero.

The material web is preferably moistened successively from two sides. Accordingly, both sides of the material web are subjected to the same treatment. Because the moisture is applied successively, it is possible to apply the moisture under optimum conditions to each side.

In an apparatus of the above-described type, the object of the present invention is met by arranging, in travel direction of the material web, a moistening section following the cooling section and an after-cooling section following the moistening section.

In the moistening section, the material web is moistened once again and, in the after-cooling section, the temperature increase of the material web occurring during the moistening step is reversed. At the end of the after-cooling section, a material web is available which has improved manipulation properties, particularly with a lower risk of breaking when being folded and a reduced waviness.

The moistening section advantageously includes at least one steam spray pipe directed against the material web. The steam spray pipe produces a directed steam jet which, in this case, is directed with a certain pressure or a certain velocity against the material web. The jet is capable of penetrating the air layer adhering to the material web, so that the steam can condense directly on the surface of the material web which is still colder as a result of the preceding cooling section. The condensing steam forms a moisture film which is relatively uniform on the surface of the web. The moisture film, in turn, results in moistening of the material web, at least on the surface thereof.

The steam spray pipe is preferably directed against the bottom side of the material web. As a result, as already mentioned above, the natural tendency of the steam to rise towards the top is utilized. This results in an improved transportation of the steam and, thus, in an improved efficiency.

A catch basin is preferably arranged underneath the steam spray pipe. In the event that droplets are formed and separated from the material web in spite of all precautionary measures, for example, during the start-up of the apparatus, the catch basin has the purpose to ensure that the water can be transported away directly without causing further damage. This drastically reduces the risk of corrosion damage.

The catch basin preferably has upwardly extending side walls which form a steam chamber together with the material web and possibly at least one guide roll. In this steam chamber, a steam atmosphere can form. In the desired extreme case, the atmosphere in this steam chamber can be free of air. This decisively improves the transition of the steam to the material web, i.e., the formation of a condensate film. This, in turn, provides the result that the material web is moistened with the necessary reliability and to the desired extent.

The guide roll following the steam spray pipe in travel direction of the material web is preferably arranged on the same side of the material web as the steam spray pipe. As mentioned above, this arrangement facilitates the formation of a wedge between the guide roll and the material web. In this wedge, the moisture available on the surface of the material web is pressed by external forces into the material web. This drastically reduces the time required for moistening the material web. It is even possible in this manner to moisten a material web which has a reduced permeability to water because of the printing inks or a previously applied layer.

The moistening section is advantageously provided with a suction device. The suction device serves to remove excess steam, so that the steam cannot precipitate or can only precipitate to a small extent on other components of the apparatus. This also reduces the risk of corrosion.

The moistening section is preferably arranged above the cooling section. In a normal printing plant, sufficient space is available for the moistening section above the cooling section. This arrangement makes it possible to retrofit existing printing plants.

The after-cooling section is preferably arranged immediately next to the moistening section. As a result, the temperature increase, which occurs due to the application of steam initially at the surface, is very quickly eliminated, so that the heat has practically no opportunity or has only a limited opportunity to penetrate into the interior of the material web.

In accordance with another preferred development of the invention, the after-cooling section is constructed as a part of the cooling section, wherein the material web is conducted out of the cooling section prior to the end of the cooling section, is conducted through the moistening section and is then reintroduced into the cooling section. Consequently, a separate after-cooling section is practically not required. Rather, the after-cooling section is integrated in the already existing cooling section. In many cases, the power of the existing cooling section is sufficient or may even be too high, so that these power reserves can be utilized for carrying out moistening with subsequent repeated cooling.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DETAILED DESCRIPTION OF THE PREFERRED EMBODIMENTS

Figure 1:
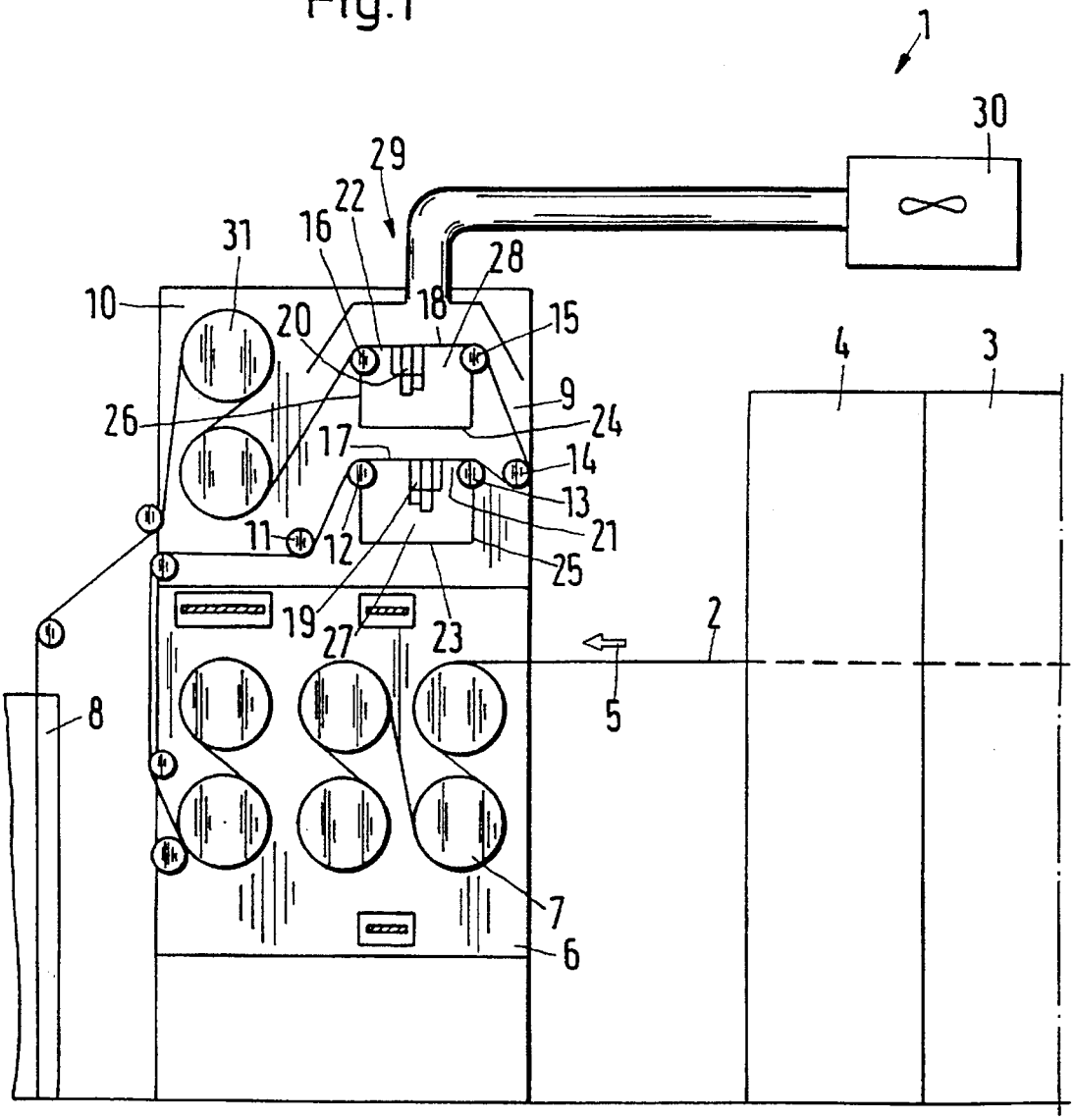
FIG. 1 is a partially schematic view of a first embodiment of an apparatus for printing a paper web according to the present invention.

As illustrated in FIG. 1, an apparatus 1 for printing a paper web 2 has an only schematically illustrated printing section 3 in which one or more inks are applied to the paper web 2 in the known manner. The printing section 3 is following by a drying section 4 in which the paper web 2 is dried with the use of heat.

The drying section 4 is followed in travel direction 5 by a cooling section 6 which is provided in the known manner by cooling rolls 7. In the illustrated embodiment, the cooling section 6 has six cooling rolls 7. The paper web 2 is guided around each of the cooling rolls 7 with an angle of contact which is as large as possible. The cooling rolls 7 may be cooled, for example, by water. The cooling rolls 7 have the purpose of removing the heat introduced into the paper web 2 in the drying section 4 and, consequently, to lower the temperature of the paper web 2. The cooling section 6 is usually followed by a processing section 8 in which the paper web is cut, folded, stitched or bound or further processed in some other manner.

However, in the illustrated embodiment according to the present invention, the paper web 2 is guided between the cooling section 6 and the processing section 8 through a moistening section 9 which is followed by an after-cooling section 10.

In the moistening section 9, the paper web 2 is guided around several guide rolls 11 to 16, wherein the paper web 2 extends essentially horizontally between the two guide rolls 12 and 13 and the two guide rolls 15 and 16. In the horizontal portions 17, 18, steam spray pipes 19, 20 are arranged in such a way that they direct a steam jet against the respective bottom side of the paper web 2. Since the paper web 2 has previously been guided through the cooling section 6 and, thus, has a relatively low temperature, the steam conducted by means of the directed steam jet against the paper web 2 can condensate on the paper web 2. The steam forms a moisture film which is relatively uniform. During normal operation, the formation of droplets is almost completely avoided. This can be achieved particularly by controlling the quantity of the discharged steam in such a way that only such an amount of steam is discharged which can actually condensate on the paper web.

As is apparent from the drawing, the guide rolls 13, 16 following the steam spray pipes 19, 20 are arranged in such a way that the paper web 2 extends at least partially around the guide rolls 13, 16, respectively. This results in the formation of a moisture wedge 21, 22 at which the moisture layer on the surface of the paper web 2 is essentially pressed into the paper web 2. As a result, the absorption of moisture is improved.

A catch basin 23, 24 each is arranged underneath the steam spray pipes 19, 20, so that any water which may have dropped down in the form of droplets is collected and can be conducted away. Such water droplets can form under unfavorable conditions during start-up or during restart of the apparatus 1.

The catch basins 23, 24 have side walls 25, 26 which extend upwardly in such a way that they form steam chambers 27, 28 together with the portions 17, 18 of the paper web 2 and the guide rolls 12, 13 and 15, 16, respectively. These steam chambers 27, 28 can be filled completely with steam, i.e., they can be practically free of air, so that the transfer of moisture onto the paper web 2 by means of steam is further improved.

The moistening section 9 is additionally provided with a steam suction device 29 which is used to withdraw excess steam, for example, by means of a fan 30. The steam withdrawn in this manner can also be returned to the system.

The moistening section 9 is followed by the after-cooling section 10 which includes two additional cooling rolls 31. The after-cooling section 10 reverses the temperature increase of the paper web 2 produced in the moistening section 9.

The paper web 2 then travels in the usual manner into the processing section 8 in order to be further processed, as described above.

The moistening section 9 is arranged above the cooling section 6. Sufficient space is available for the moistening section 9 above the cooling section 6. The after-cooling section 10 is arranged immediately adjacent the moistening section 9. In the illustrated embodiment, the after-cooling section 10 is also arranged above the cooling section 6.

Figure 2:
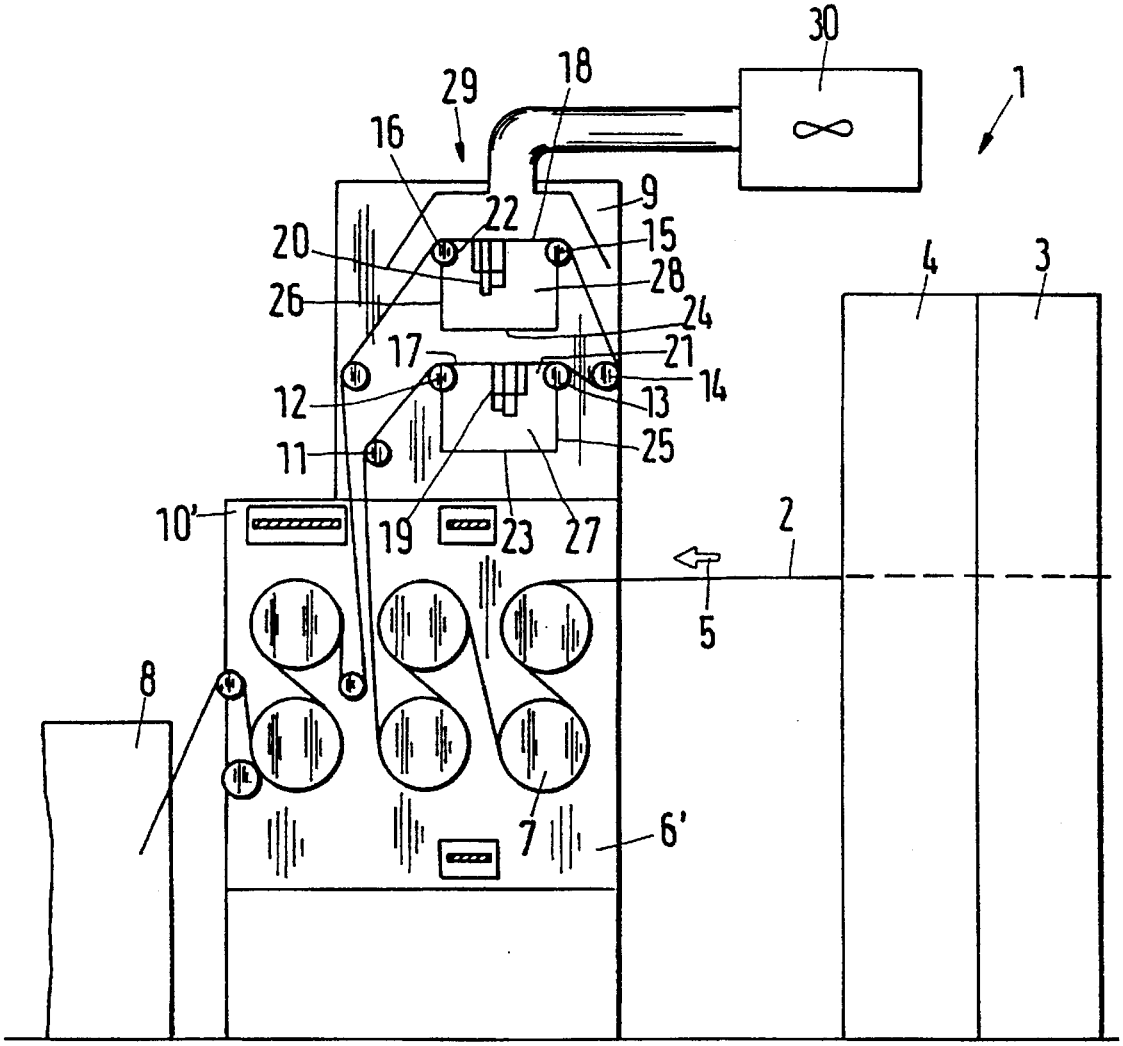
FIG. 2 is a schematic view, similar to FIG. 1, of a second embodiment of the apparatus according to the present invention.

In the embodiment of FIG. 2, those components which are equal to those of the embodiment of FIG. 1 are provided with the same reference numerals. In the case of equivalent components, the reference numerals are provided with "'".

As is shown in FIG. 2, the after-cooling section 10' constitutes a portion of the cooling section 6'. In contrast to the embodiment of FIG. 1, the paper web 2 travels in the cooling section 6' prior to entering the moistening section 9 no longer over six cooling rolls 7, but only over four cooling rolls 7. Subsequently, the paper web 2 is guided out of the cooling section 6, is guided through the moistening section 9 and is returned into the cooling section 6' where it travels around two additional cooling rolls 7. In this manner, a separate structural group for the after-cooling section 10 is unnecessary. On the other hand, fewer cooling rolls 7 are available in the cooling section 6'. However, this is not a problem in many cases because the cooling rolls 7 frequently have sufficient power reserves.

The invention is not limited by the embodiments described above which are presented as examples only but can be modified in various ways within the scope of protection defined by the appended patent claims.

I claim:

1. An apparatus for printing a paper web traveling in a travel direction, the apparatus comprising a printing unit, a drying section following the printing unit, a cooling section following the drying section, a steam operated moistening and heating section following the cooling section, and an after-cooling section following the moistening section.

2. The apparatus according to claim 1, wherein the moistening section comprises at least one steam spray pipe directed toward the paper web.

3. The apparatus according to claim 2, wherein the steam spray pipe is directed toward a bottom side of the paper web.

4. The apparatus according to claim 1, wherein the moistening section comprises a suction device for drawing off water droplets.

5. The apparatus according to claim 1, wherein the moistening section is arranged above the cooling section.

6. The apparatus according to claim 1, wherein the after-cooling section is arranged immediately next to the moistening section.

7. An apparatus for printing a material web traveling in a traveling direction, the apparatus comprising a printing unit, a drying section following the printing unit, a cooling section following the drying section, a moistening section following the cooling section, and an after-cooling section following the moistening section, wherein the moistening section comprises at least one steam spray pipe directed toward the material web, and wherein the steam spray pipe is directed toward a bottom side of the material web, further comprising a catch basin arranged underneath the steam spray pipes.

8. The apparatus according to claim 7, wherein the catch basin comprises upwardly extending side walls, wherein the side walls form a steam chamber together with the material web and at least one guide roll for the material web.

9. The apparatus according to claim 2, comprising a guide roll arranged following the steam spray pipe in the travel direction of the paper web, the guide roll being arranged on a side of the paper web on which the steam spray pipe is arranged.

10. An apparatus for printing a material web traveling in a travel direction, the apparatus comprising a printing unit, a drying section following the printing unit, a cooling section following the drying section, a steam operated moistening and heating section following the cooling section, and an after-cooling section following the moistening section, wherein the after-cooling section is constructed as an integral component of the cooling section, comprising means for guiding the material web from the cooling section through the moistening section and back into the cooling section.

* * * * *